United States Patent [19]

Baus

[11] Patent Number: 4,856,126

[45] Date of Patent: Aug. 15, 1989

[54] SHOWER PARTITION

[76] Inventor: Heinz G. Baus, Wartbodenstrasse 35, CH-3626 Huenibach-Thun, Switzerland

[21] Appl. No.: 156,994

[22] Filed: Feb. 18, 1988

[30] Foreign Application Priority Data

| | | | |
|---|---|---|---|
| Feb. 20, 1987 | [DE] | Fed. Rep. of Germany | URA 209/87 |
| Mar. 11, 1987 | [DE] | Fed. Rep. of Germany | 3707795 |
| Mar. 11, 1987 | [WO] | World Int. Prop. O. | DM/008309 |
| Jan. 26, 1988 | [EP] | European Pat. Off. | 88101049.0 |

[51] Int. Cl.[4] ..... A47K 3/22

[52] U.S. Cl. ..... 4/607; 4/612; D23/305

[58] Field of Search ..... 4/607, 610, 612, 613, 4/614, 557, 596; D23/283, 304, 305, 306; 49/460, 366; D25/47, 48; D8/300, 313, 314; 16/110 R, 110 S, 111 R, 113, 124, 125

[56] References Cited

U.S. PATENT DOCUMENTS

| | | | |
|---|---|---|---|
| D. 143,429 | 1/1946 | Ketchum, Jr. | D25/48 |
| D. 203,385 | 1/1966 | Hinrichs | D8/314 |
| D. 203,743 | 2/1966 | Riegelman | D8/314 |
| D. 217,596 | 5/1970 | Johnston | D25/48 |
| 2,766,857 | 10/1956 | Miller | 49/460 |
| 3,827,183 | 8/1974 | Zimmerman et al. | 16/111 |
| 4,564,963 | 1/1986 | Bergmark | 4/610 |
| 4,715,072 | 12/1987 | Sudmann | 4/607 |
| 4,720,876 | 1/1988 | Tomei et al. | 4/607 |

FOREIGN PATENT DOCUMENTS

| | | |
|---|---|---|
| 3433135 | 2/1986 | Fed. Rep. of Germany . |
| 3308452 | 11/1986 | Fed. Rep. of Germany . |

*Primary Examiner*—Linda J. Sholl

*Attorney, Agent, or Firm*—Foley & Lardner, Schwartz, Jeffery, Schwaab, Mack, Blumenthal & Evans

[57] ABSTRACT

A shower partition comprising a door (2) which serves to close or open an entry opening into a shower basin (4) and which is preferably configured as a pivotable wing. The door (2) is advantageously produced in a deep drawing process and has a circumferential recess (26) on its front surface adjacent the outer edges. A preferably tubular frame (28) is associated with the recess and spaced from the front surface of the door (2). The resulting structure has good stability and simultaneously achieves good sealing of the entry opening with a door of low weight. A trough (77) on the back of the door sloping downwardly toward the hinged door edge conveys water running down the rear side of the door back into the shower basin when the door is opened.

22 Claims, 6 Drawing Sheets

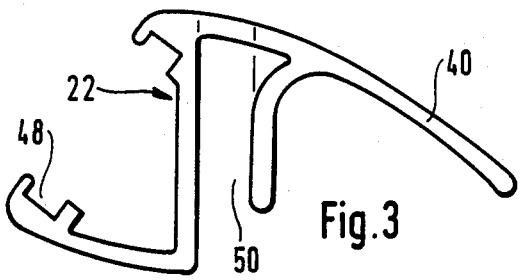
Fig. 3
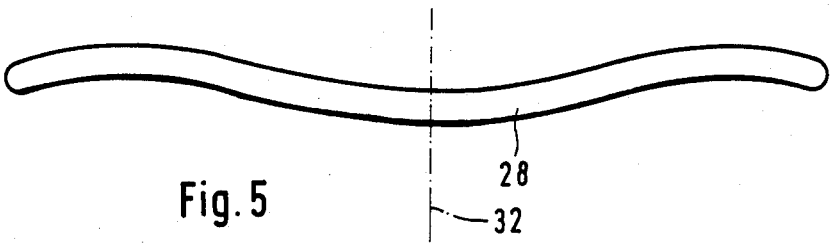
Fig. 5
Fig. 4
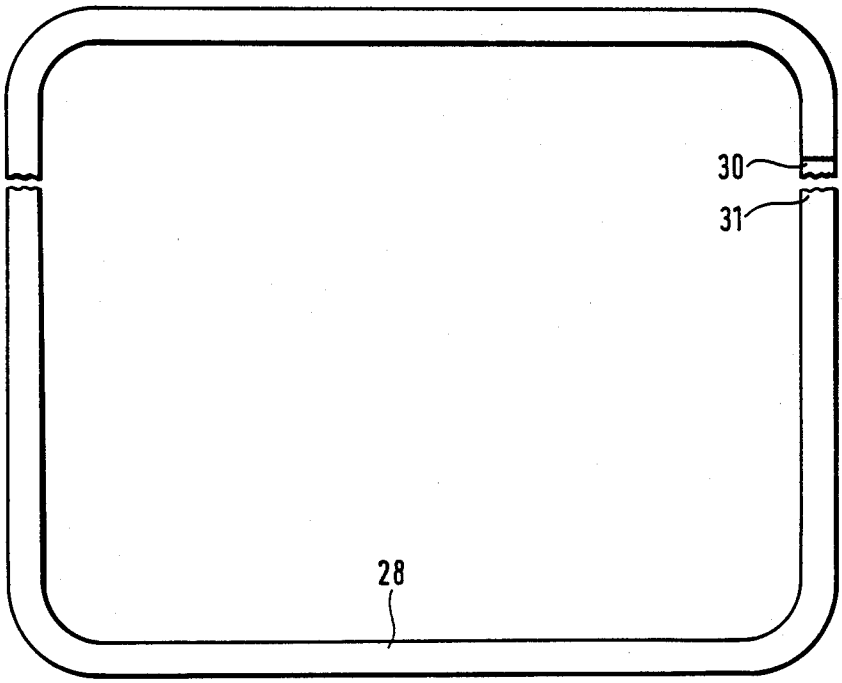

SHOWER PARTITION

BACKGROUND OF THE INVENTION

The present invention relates to a shower partition with a door which is constructed, in particular, as a pivotable wing, hingedly mounted next to a wall by means of hinges with a substantially vertical pivot axis, and which serves to open or close an entrance opening to a shower compartment.

A shower partition of the aforesaid type is disclosed in German Patent No. DE-PS 34 33 135, in which a contact rail or stop is fixedly arranged on the longitudinal edge of the pivotable wing remote from the hinge, for example, on a room wall. In the area where the pivotable wing is attached to the hinge or to arms of the hinge, an elongated slot extending transversely to the axis of rotation is provided in order to facilitate adjustment in each case. Because of these elongated slots, the spacing of the pivotable wing from the room wall or from a profile rail provided on the wall can be varied in order to compensate for tolerances of the construction site or to effect an adjustment corresponding to the varying widths of shower basins. In the direction of view toward the shower basin, the pivotable wing is arranged behind the vertical pivot axis and can be pushed by means of its forward edge adjacent the hinge behind the first profiled rail to effect an adjustment. Depending on the size of the range of adjustment, the first profiled rail consequently must have a comparatively large width, whereby the width of the opening available to a user is adversely affected.

SUMMARY OF THE INVENTION

The object of the invention is to provide an improved shower partition of the aforementioned type, at low cost in such a way that simple assembly and use are assured.

An additional object of the invention is to provide a shower partition in which a reliable seal is assured both at the vertical edges of the door and also between an underlying shower basin and the door.

It is also an object of the invention to provide a shower partition which can be quickly and securely assembled without any need for costly work operations, such as cutting of shaped rails, or use of expensive tools and the like.

Another object of the invention is to provide a shower partition which produces a properly functional and reliable sealing of the entrance opening using only a few parts.

A still further object of the invention is to provide a shower partition in which the assembly and adjustment of the door or pivotable wing can be completed quickly and with high precision, even when the tolerances of the construction site are large.

Installation should be possible with only a few component parts in shower basins of varying width, and costly mounting supports and finishing of different shaped rails, or other accessories should be avoided. An exact vertical orientation of the pivotable wing should be assured, so that even after a long period of use, easy manipulation or movement of the pivotable wing is possible.

These and other objects of the invention are achieved by providing a shower partition with a door constructed as a pivotable wing pivotably mounted on a wall by means of hinges with a substantially vertical pivot axis and which serves to open or close an entry opening to a shower compartment, wherein said door has a circumferential recess in its front surface adjacent its outer margins, and a frame is associated with said recess and is spaced from the front surface of the door.

In accordance with the invention, it is proposed that the door have a circumferential recess in its front surface adjacent the outer edge, and that a tubular frame spaced from the front of the door be associated with the recess. In a particularly preferred embodiment, the door is manufactured by a deep drawing process.

The proposed shower partition is distinguished by a simple construction, whereby the door has both a low weight and a high stability at the same time. The door has an edge flange directed toward the rear, i.e., toward the interior space of the shower compartment. Preferably, this rearwardly extending edge flange is constructed integrally with the door and is simultaneously formed during deep drawing or other production processes. By means of this flange, which advantageously extends at approximately a right angle to the door, good stability and structural rigidity are achieved. The circumferential recess provided in the front of the door also significantly improves the stability of the door. A tubular frame is mounted on the front of the door adjacent the circumferential recess in such a way that the tubular frame is spaced from the front of the door by means of spacers.

In contrast to conventional shower partition doors, the door or door panel of the present invention is not enclosed in a framework of profiled rails. Instead, the frame is attached to the front surface of the door and has smaller height and width measurements than the rearwardly directed peripheral flange of the door. The one-piece tubular frame of the invention serves on the one hand as supplemental reinforcement of the door. On the other hand, the tubular frame can be grasped, at least along the vertical longitudinal edge of the door, by a user as a grip.

By means of the peripheral flange and/or the rearwardly directed circumferential recess, it is assured in a surprisingly simple manner that water can be prevented from spraying out from the enclosure without any difficulty or additional expense. This applies most of all in the vicinity of the lower edge of the door in the gap between the bottom of the door and the shower basin, so that a supplemental seal at the lower edge of the door can be omitted. Because the flange is directed rearwardly, i.e., toward the interior space above the shower basin, there may be a relatively wide gap between the upper edge of the shower basin and the bottom of the door, and it is accordingly possible to have a non-contact seal.

In a particularly preferred embodiment, the door and the tubular frame are bent in wave-form such that a wave trough is arranged in the vertical central surface of the door. The wave-form configuration of the door substantially improves its stability. The weight of the door can consequently be kept low without any fear of damage during use. The material thickness of the door can be kept small, whereby substantial savings of material and reduction of weight are achieved. Furthermore, a favorable visual appearance is achieved at low cost.

In a particularly preferred embodiment for a corner shower, the shower partition has two pivotable wings of the aforedescribed type which are pivotably mounted at a right angle to each other on hinges, particularly with mounting pillars or the like. The shower compartment is entered through its free corner which extends into the shower room or bathroom, whereby, by opening both of the pivotable wings, a large entry opening is achieved in a simple manner.

In accordance with the invention, the door may advantageously be pivoted at a point about one-third of the way along its total width so that when the pivotable wings are in the open position, the user can step into or out of the shower basin without difficulty.

BRIEF DESCRIPTION OF THE DRAWINGS

The invention will be explained in further detail hereinafter with reference to an exemplary embodiment illustrated in the accompanying drawings, wherein

FIG. 3 is an enlarged sectional view of a fastener edge piece which cooperates with a fastener edge piece illustrated in FIG. 2;

FIG. 4 shows a front view of a circumferential frame;

FIG. 5 is a top view of the frame of FIG. 4 in the viewing direction V;

DETAILED DESCRIPTION OF THE PREFERRED EMBODIMENTS

Figure 1:
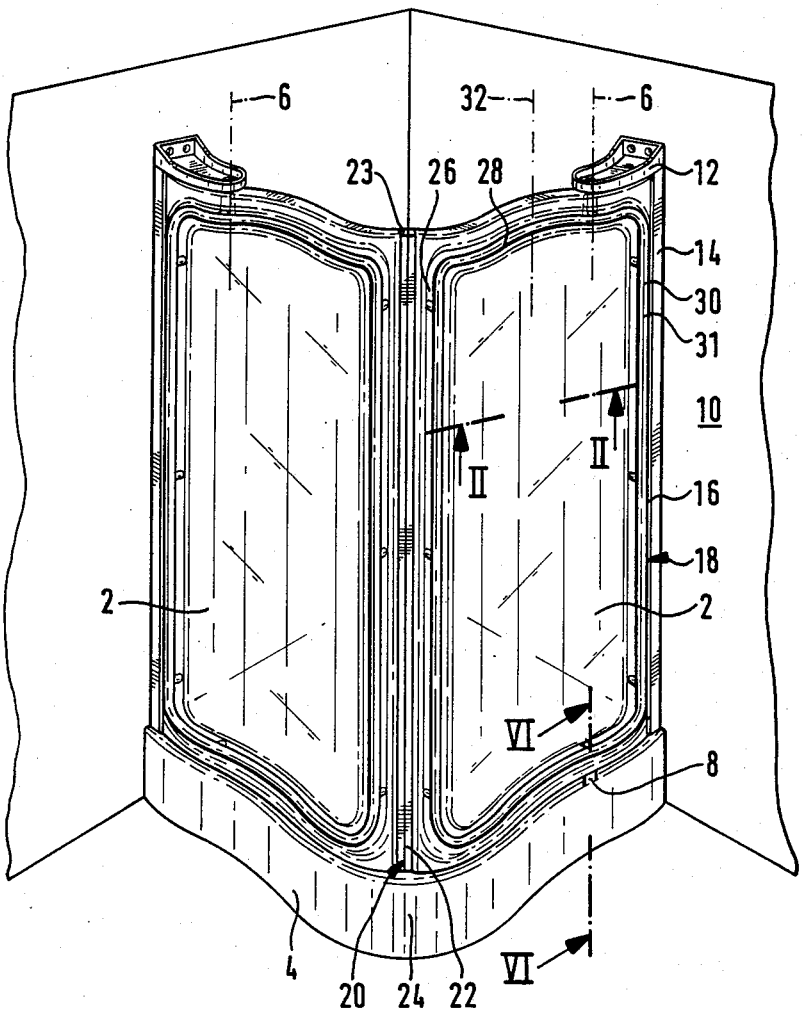
FIG. 1 shows a schematic perspective view of the shower partition of the present invention.

FIG. 1 shows a shower partition with two doors 2 which are constructed as pivotable wings and are pivotably mounted above a shower basin 4 for rotation around an axis 6. A mounting pillar 8 for a lower pivot mount is attached to the upper margin of the shower basin 4. An upper mounting arm 12 is attached above the door on a wall 10 of the room. Mounting arm 12 defines the upper pivot mount for door 2. A profiled rail 14 is arranged on the wall 10 of the room extending from the upper margin of shower basin 4 upwardly to the mounting arm 12. Profiled rail 14 contains a seal member 16 formed of an elastic synthetic plastic material or of rubber. In the illustrated closed position of the doors, each door 2 lies with its longitudinal edge 18, which faces toward wall 10 of the room, adjacent the seal member On the free, other vertical longitudinal edge 20 of each door 2, a shaped edge piece 22, which contains a magnetic seal and a grip flange, is attached with end caps 23. The shower partition comprises two doors 2 which are mirror images of each other. To open the entry which is located above the corner 24 of shower basin 4, each door 2 is pivoted about its respective axis of rotation 6 in such a way that the free vertical longitudinal edge 20 is pivoted forwardly out of the plane of the drawing. The spacing between axis of rotation 6 and longitudinal edge 18 is from 20 to 40 percent, preferably approximately one-third or 30 percent, of the total width of the door. Thus, after the door 2 has been pivoted outwardly, approximately two-thirds of the total width in the direction of view shown in the drawing, is made available (i.e., opened up). When constructed as a corner entry with two pivotable doors or wings arranged at right angles to each other, the width of the free opening is substantially equal to the square root of two times the square of two-thirds of the width of each pivotable wing.

Door 2 is provided with a rearwardly directed recess 26 extending around the periphery of the door. A frame 28 is associated with the recess 26. Frame 28 comprises a bent tube, the ends 30 and 31 of which meet each other. This tubular frame is not a heretofore conventional frame which receives the edges of a transparent plate or sheet. Rather, this tubular frame 28 is arranged adjacent recess 26 or the front surface of the door in spaced relation thereto as will be explained in greater detail hereinafter. In the vicinity of the free vertical longitudinal edge 20 of the door, the tubular frame 28 serves as an outer handle or grip for a user. In accordance with the invention, the spacing of the frame 28 from the door 2 or the bottom of recess 26, at least in the vicinity of longitudinal edge 20, is chosen in such a manner that the fingers of a user can encircle the frame without difficulty. If desired, the depth of recess 26 in the vicinity of the upper and lower edges of the door may be smaller than in the vicinity of vertical longitudinal edge 20.

In the aforedescribed embodiment the width of door 2 corresponds substantially to the length of the side of the shower basin 4, and the upper mounting arm 12 is attached directly to the wall 10 of the room. It is also within the scope of the invention to construct the door 2 with a smaller width, whereby a fixed wall element is arranged adjacent the wall of the room. In accordance with the invention, this wall element may, in principle, have the same construction as the door 2, that is to say it may be formed with a circumferential recess and a tubular frame. In such an embodiment, the upper mounting arm may conveniently be attached to the fixed wall element rather than to the room wall.

Figure 2:
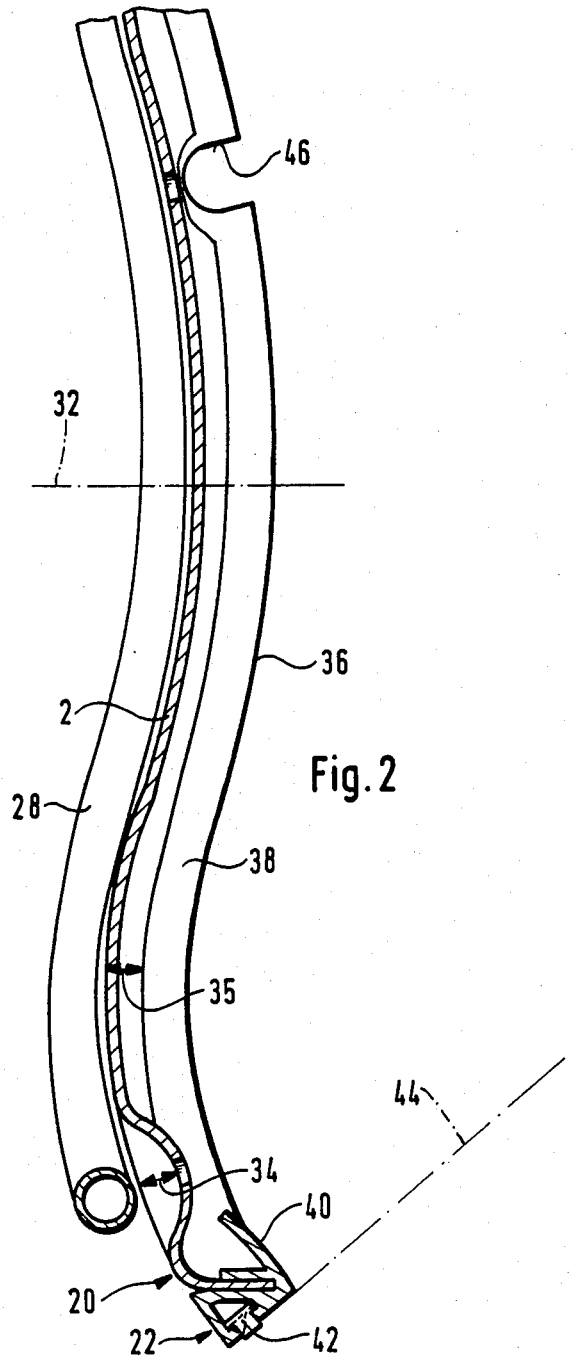
FIG. 2 is an enlarged sectional view taken along section line II—II of FIG. 1.

In the enlarged section illustrated in FIG. 2, the door 2, which has been produced by a deep drawing process, can clearly be seen with the tubular frame 28. The door, together with the tubular frame, is substantially symmetrically formed with respect to the central plane 32. The recess 26 has a depth 34 along the longitudinal edge 20 which is larger than the depth 35 along the upper edge 36 of the door. The depth 34 is selected in such a manner that a user can enclose the tubular frame with his fingers and not get caught in the recess 26. The door 2 has a rearwardly directed margin or flange 38 on the back, which on the one hand facilitates good stability, and on the other hand, also facilitates a good seal in a simple manner, particularly between the lower edge of the door and upper margin of the shower basin. In the vicinity of the free vertical longitudinal edge 20, the shaped edge member 22 is attached to the edge flange 38 in accordance with the invention. The shaped edge member 22 is attached to the door 2 by means of end caps 23 at the upper and lower ends of the door. The shaped edge member 22 has a grip flange 40 adjacent the rear side of door 2, by means of which a user standing in the shower basin can open and close the door.

The shaped edge member 22, which is pushed onto the edge 38, forms a good finish for edge 38, so that any pinching or injury to a user can be reliably prevented. The shaped edge member 22 further contains a magnetic strip 42 in an undercut longitudinal groove 48. Magnetic strip 42 cooperates with an appropriately polarized further magnetic strip on the other door to form a magnetic catch. The other door is arranged in a corresponding manner symmetrically with respect to the diagonal plane of symmetry 44 which extends substantially along the diagonal of the shower basin from the free corner of the shower basin to the corner of the room.

Door 2 has a cut-out 46 in the upper margin 36 through which an upper pivot mount attached to the door extends. A corresponding cut-out for a lower mounting piece is also provided in the lower edge of the door. The upper mounting piece or pivot mount is received in the upper mounting arm 12.

As can be seen from the drawings, door 2 and tubular frame 28 have a wave-like form in which a wave trough is disposed in the vicinity of the central plane 32 of the door. As a result of this wave-like form, a high structural rigidity is assured with minimal consumption of material and a low weight. The wave-like configuration of the door may match the configuration of an underlying shower basin with a wave-like side wall.

FIG. 3 shows an enlargement of the shaped edge member 22 with the grip flange 40 and the undercut groove 48 for the magnetic strip. During manufacture, the edge flange 38 at the side 20 of the door is inserted into the gap 50. Attachment of edge member 22 to the door can be effected by means of the previously mentioned end caps 23, or alternatively, by means of adhesive bonding or the use of screws.

FIGS. 4 and 5 show an elevational view and a plan view of the tubular frame 28. The wave-like form of the tubular frame, according to the invention, can clearly be seen in FIG. 5, in which the vertical central plane 32 coincides with a wave trough.

Figure 6:
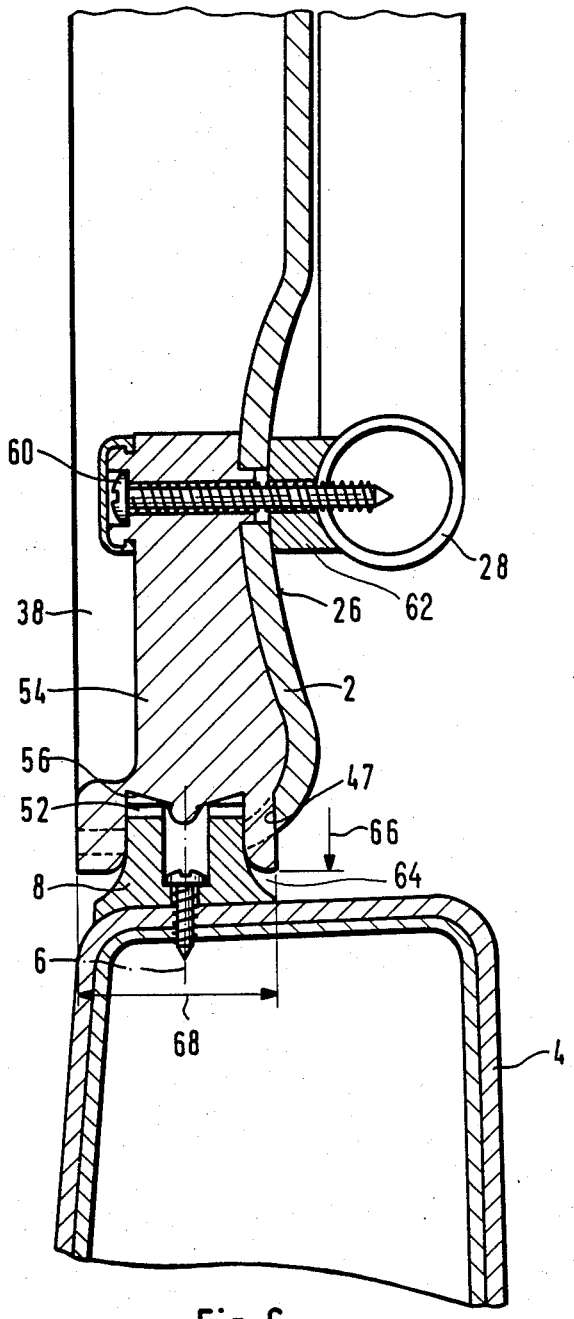
FIG. 6 is an enlarged vertical sectional view taken along line VI—VI of FIG. 1.

FIG. 6 shows an enlarged section through the lower pivot mount with a mounting pillar 8 attached directly to the upper margin of shower basin 4 by means of a screw. Mounting pillar 8 has at least one inclined surface 52 on which a pivotable mounting piece 54 with a conical inner surface 56 lies. The pivotable mounting piece 54 receives the fixed mounting pillar 8 in a cylindrical recess 58. The lower end of mounting piece 54 extends downwardly through the cut-out 47 in the edge 38 of door 2, and the upper part of mounting piece is attached to door 2. Mounting piece 54 and tubular frame 28 are connected to the door 2 by means of a fastening element 60, which in the illustrated embodiment takes the form of a screw. A spacer 62 is positioned in the recess 26 between the circumferential tubular frame 28 and the door 2. A pivotable mounting piece for the upper pivot mount is arranged in a corresponding manner at the upper edge of the door. Further, the tubular frame is also connected to door 2 in a corresponding manner at other locations in recess 26 by means of fastening elements, e.g. screws. The fastening elements may advantageously be arranged in such a manner that they are inserted from the rear of the door through the door and the intervening spacers into the tubular frame 28, and the tubular frame is otherwise completely free from the front surface of the door.

Because of the configuration of rearwardly extending edge 38, the gap 64 between the lower edge of the door and the shower basin has a height 66 and a depth 68. Due to the comparatively large depth 68, a reliable sealing effect is surprisingly achieved in this gap without taking any further sealing measures. In addition, the height 66 can be chosen to be relatively small so that sprayed water cannot pass from the interior of the shower compartment, i.e., from the rear to the front of the shower door. Because of the previously mentioned inclined surface 52 of mounting pillar 8, door 2 is lifted vertically upwardly as it is opened so that the lower edge of the door is reliably prevented from scraping against the shower basin.

Figure 7:
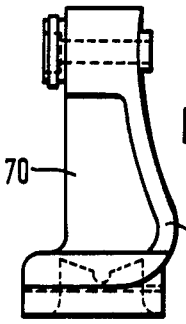
FIG. 7 is a view of the lower pivoting door mount viewed in the same direction as the view of FIG. 6.
Figure 8:
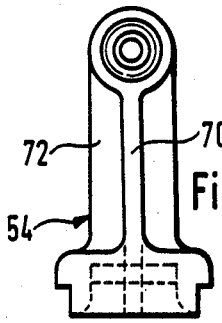
FIG. 8 is a rear view of the pivoting door mount of FIG. 7 in direction VIII.

FIGS. 7 and 8 show mounting piece 54. In order to save material, the mounting piece is not formed as a solid mass. Instead, it has a reinforcing rib 70 in the center supporting a relatively wide mounting surface 72 which lies against the door 2.

Figure 9:
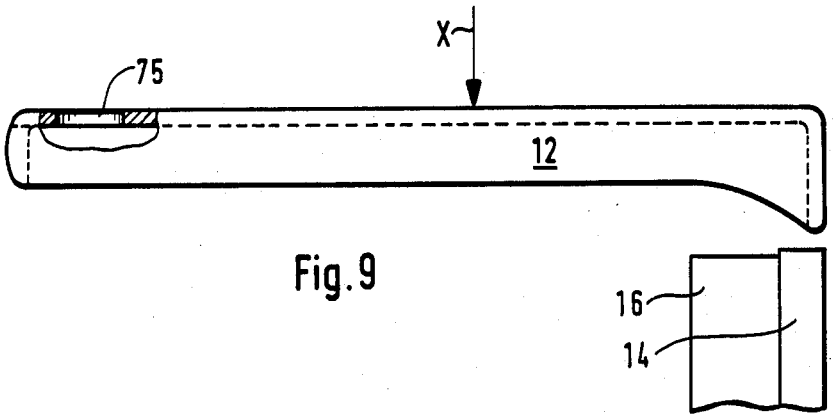
FIG. 9 is an enlarged side view of an upper mounting arm for a modified embodiment.
Figure 10:
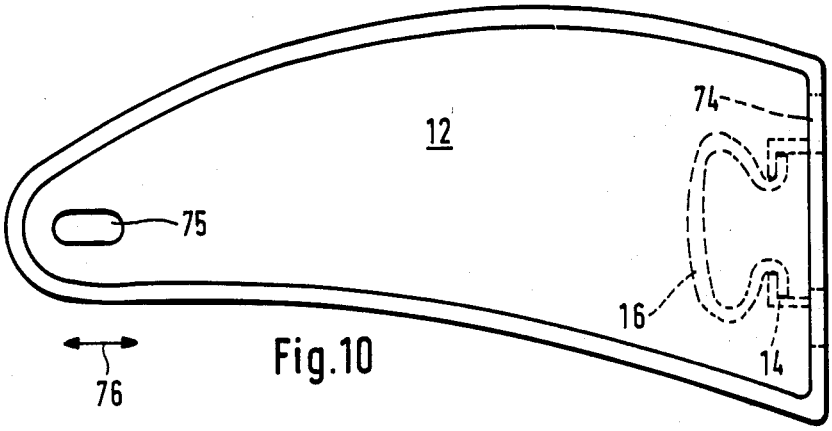
FIG. 10 is a top view of the mounting arm of FIG. 9 in the direction X.

FIGS. 9 and 10 show an elevational view and a plan view of the upper mounting arm 12 together with profiled rail 14 and seal member 16. The mounting arm 12 and the profiled rail 14 are fastened directly to the wall of the room by means of screws. For purposes of adjustment, mounting arm 12 has two elongated slots 74 in the side which abuts the wall 10. Another elongated slot 75 is provided at the free end of mounting arm 12 for the upper pivotable mounting piece, so that it is possible to adjust the position of the pivot pin or the mounting piece together with the door in the direction indicated by arrow 76. A positional adjustment perpendicular to the arrow 76 can take place due to the elongated slots 74 provided for attaching the mounting arm to the wall of the room. When closed, door 2 lies with the margin of its vertical longitudinal edge 18 adjacent the sealing member 16, so that a reliable seal is assured by the relatively large contact surfaces of the door margin and the sealing member 16.

Figure 11:
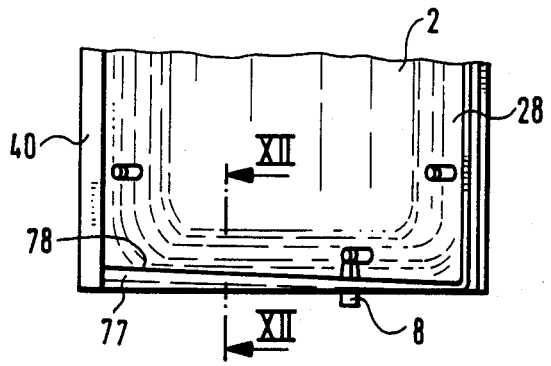
FIG. 11 is a view of the lower edge of the door shown at the left in FIG. 1, viewed from inside the shower basin looking outward.

FIG. 11 shows a view of the lower edge of the door 2 shown at the left in FIG. 1, as viewed from a point inside the shower basin. The frame 28, which lies behind the plane of the drawing, can be seen through the door 2, which is formed of a transparent synthetic plastic material. Grip 40 on the vertical longitudinal edge of the door 2 and also the mounting pillar 8 can be clearly seen. Adjacent the lower edge, the door 2 is provided with a collecting trough 77 for water. This collecting trough 77 is an integral part of door 2 and is formed by bending the lower edge of the door around. The collecting trough 77 extends from the grip 40 or the free vertical longitudinal edge at least to the mounting pillar 8 which is mounted on the margin of the shower basin. The upper edge 78, and advantageously the entire collecting trough 77, are arranged with a slight fall or inclination from the grip 40 toward the mounting pillar 8. When the door is pivoted about the axis of the mounting pillar to open the entry, then the portion of the door between the grip and the mounting pillar is moved outwardly in front of the shower basin. Any water on the back of the door can flow down and will be collected in the collecting trough 77 and then flow past the mounting pillar into the shower basin. Thus, escape of water from the area of the shower basin is avoided even when the door is open.

Figure 12:
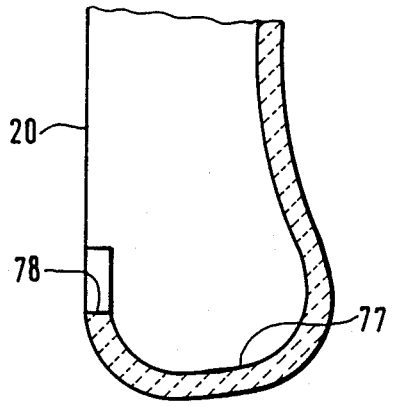
FIG. 12 is a sectional view taken along line XII—XII of FIG. 11.

FIG. 12 shows a section along section line XII—XII in FIG. 11, whereby, for simplicity of illustration, the grip rod and the frame are not shown. The collecting trough 77 at the lower edge of the door 2 can be seen, the edge 78 of which rises toward the free vertical edge 20 of the door 2 as viewed from the plane of the drawing or the mounting pillar.

The foregoing description has been set forth merely to illustrate the invention and is not intended to be limiting. Since modifications of the described embodiments incorporating the spirit and substance of the invention may occur to persons skilled in the art, the invention should be construed to include everything within the scope of the appended claims and equivalents.

What is claimed is:

1. A shower partition with a door constructed as a pivotable wing pivotably mounted on a wall by means of hinges with a substantially vertical pivot axis and which serves to open or close an entry opening to a shower compartment, wherein said door has a circumferential recess in its front surface adjacent its outer margins, and a frame is associated with said recess and is spaced from the front surface of the door.

2. A shower partition according to claim 1, wherein said door is manufactured by a deep drawing process, and said frame is formed from a tube.

3. A shower partition according to claim 1, wherein said door is provided with a rearwardly directed flange formed integrally with the door.

4. A shower partition according to claim 1, wherein said frame is mounted in said recess spaced from the front of said door by means of spacers.

5. A shower partition according claim 1, wherein said door is pivotably mounted at the top by means of an upper mounting arm which defines the pivot axis of the door.

6. A shower partition according to claim 1, wherein said door is pivotably mounted at the bottom by means of a mounting piece received on a mounting pillar attached directly to an underlying shower basin.

7. A shower partition according to claim 6, wherein said mounting pillar comprises an inclined surface for vertically lifting the door when the door is opened.

8. A shower partition according to claim 6, wherein said mounting piece rotates with the door and is attached to the rear of said door and said frame is attached to the front of said door by means of fastening elements which extend from said mounting piece through said door into said frame.

9. A shower partition according to claim 1, wherein said recess adjacent the free vertical longitudinal edge of said door has a greater depth than the depth of the recess adjacent the upper and lower edges of the door, and said frame adjacent the free longitudinal edge of said door serves as a hand grip.

10. A shower partition according to claim 5, wherein said mounting arm is arranged above the upper edge of said door.

11. A shower partition according to claim 1, wherein the pivot axis is arranged spaced from 20 to 40 percent of the total width of the door from the vertical longitudinal edge of the door adjacent the room wall.

12. A shower partition according to claim 11, wherein the pivot axis of the door is spaced about one-third of the width of the door from the vertical longitudinal edge of the door adjacent the room wall.

13. A shower partition according to claim 1, wherein said door and said frame are constructed with a wave-form configuration with vertically extending wave troughs and wave crests.

14. A shower partition according to claim 1, wherein said frame is fabricated as a single piece from a tube having a circular cross-section, and the ends of the tube are joined to form an endless loop.

15. A shower partition according to claim 1, wherein two mirror image doors are arranged in a symmetrical relationship substantially at a right angle to each other.

16. A shower partition according to claim 1, wherein said door has a wave-like configuration to conform to an underlying shower basin having a wave-like side configuration.

17. A shower partition according to claim 3, wherein said door has a cut-outs through said rearwardly directed flange at the top and at the bottom of said door, and an upper pivotable mounting piece mounted on said door extends through the cutout at the top to an upper mounting arm attached to an adjacent wall, and a lower pivotable mounting piece mounted on said door extends through the cutout out at the bottom to a lower mounting pillar attached to an underlying shower basin.

18. A shower partition according to claim 3, wherein an edge member is arranged adjacent the free longitudinal edge of the door, said edge member comprising a grip flange at the rear of said door and a longitudinally extending undercut groove for receiving a sealing strip.

19. A shower partition according to claim 18, wherein the edge member is configured with a recess in which said flange adjacent the free longitudinal edge of the door is received.

20. A shower partition according to claim 3, wherein between the lower edge flange of the door and the upper margin of an underlying shower basin there is a gap having a depth which is substantially greater than its height.

21. A shower partition according to claim 1, wherein a water collecting trough is arranged along the lower edge of the door which is formed integrally with the door and which extends from the free vertical edge of the door at least to the mounting pillar.

22. A shower partition according to claim 21, wherein said collecting trough is inclined downwardly from the free vertical edge of the door to the mounting pillar.

* * * * *